US010874899B2

(12) United States Patent
Innocenzi

(10) Patent No.: US 10,874,899 B2
(45) Date of Patent: Dec. 29, 2020

(54) PERSONALIZABLE MODULAR FITNESS AREA

(71) Applicant: METALCO ACTIVE S.R.L., Castelminio di Resana (IT)

(72) Inventor: Gian Luca Innocenzi, Milan (IT)

(73) Assignee: METALCO ACTIVE S.R.L., Castelminio di Resana (IT)

( * ) Notice: Subject to any disclaimer, the term of this patent is extended or adjusted under 35 U.S.C. 154(b) by 333 days.

(21) Appl. No.: 15/776,361

(22) PCT Filed: Nov. 14, 2016

(86) PCT No.: PCT/IB2016/056838
§ 371 (c)(1),
(2) Date: May 15, 2018

(87) PCT Pub. No.: WO2017/085611
PCT Pub. Date: May 26, 2017

(65) Prior Publication Data

US 2020/0254298 A1 Aug. 13, 2020

(30) Foreign Application Priority Data

Nov. 16, 2015 (IT) ..... 102015000072969

(51) Int. Cl.
*A63B 21/00* (2006.01)
*A63B 23/12* (2006.01)
(Continued)

(52) U.S. Cl.
CPC ..... *A63B 21/4035* (2015.10); *A63B 23/1209* (2013.01); *A63B 23/03525* (2013.01);
(Continued)

(58) Field of Classification Search
CPC ..... A63B 21/4035; A63B 23/1209; A63B 23/03525; A63B 2225/093;
(Continued)

(56) References Cited

U.S. PATENT DOCUMENTS 1,582,487 A * 4/1926 Shank ..... A63B 17/00 482/130
2,977,118 A * 3/1961 Farkas ..... A63B 9/00 482/35
(Continued)

FOREIGN PATENT DOCUMENTS

CA 2919594 A1 * 8/2017 ..... A63B 21/4029
DE 9003561 U1 6/1990
(Continued)

OTHER PUBLICATIONS

Movestrong Squat Stand System & Options "http://www.movestrongfit.com/shop/squat-stand-system" Oct. 18, 2014 (Year: 2014).*
(Continued)

*Primary Examiner* — Nyca T Nguyen
(74) *Attorney, Agent, or Firm* — Nixon & Vanderhye

(57) ABSTRACT

Disclosed is a reversibly installable modular fitness area including a plurality of modules, variously assemblage due to common stable and reversible connection system, which when joined together give rise to stage-like structures, each of which including one or more equipment pieces for carrying out fitness exercises. Especially opposite support modules have slingshot arm shape, and each of the stages is equipped with a display illustrating how to perform the exercise.

12 Claims, 14 Drawing Sheets

(51) Int. Cl.
*A63B 23/035* (2006.01)
*A63B 23/00* (2006.01)
*A63B 22/00* (2006.01)

(52) U.S. Cl.
CPC . *A63B 2022/0092* (2013.01); *A63B 2023/006* (2013.01); *A63B 2220/806* (2013.01); *A63B 2225/093* (2013.01)

(58) Field of Classification Search
CPC ..... A63B 2220/806; A63B 2023/006; A63B 2022/0092; A63B 2009/006; A63B 69/20–206; A63B 21/072–08; A63B 71/02; A63B 1/00; A63B 2225/09; A63B 2225/105; A63B 2244/08; A63B 21/4043; A63B 23/0405; A63B 23/0494; A63B 23/1218; A63B 23/1227; A63B 21/16; A63B 23/0205; A63B 23/03541; A63B 21/068; A63B 21/00047; A63B 17/04; A63B 69/201; A63B 71/0622; A63B 7/02; A63B 21/0023; A63B 21/0442; A63B 21/0552; A63B 2071/024; A63B 2225/50; A63B 2244/102; A63B 9/00; A63B 2009/002–006
USPC ..... D21/686
See application file for complete search history.

(56) References Cited

U.S. PATENT DOCUMENTS 4,278,250 A * 7/1981 Baynes ..... A63B 17/00 482/34
5,184,992 A * 2/1993 Banks ..... A63B 21/06 482/104
5,267,930 A * 12/1993 Henes ..... A63B 21/154 482/102
D401,985 S * 12/1998 Wheeler ..... D21/686
6,348,028 B1 * 2/2002 Cragg ..... A63B 69/201 434/248
6,464,619 B1 * 10/2002 Bondi ..... A63B 17/00 446/476
6,530,867 B2 * 3/2003 Schwendemann ... A63B 69/004 482/83
D515,166 S * 2/2006 Montfort ..... A63B 9/00 D21/826
7,658,699 B1 * 2/2010 Johnson, Jr. ..... A63B 69/201 482/83
D629,472 S * 12/2010 Rhodes ..... D21/675
8,323,158 B2 * 12/2012 Keiser ..... A63B 21/0087 482/100
D735,820 S * 8/2015 Alenaddaf ..... D21/686
9,452,309 B2 * 9/2016 Scaramucci ..... A63B 17/04
10,016,646 B2 * 7/2018 Butler ..... A63B 21/0724
2007/0032357 A1 * 2/2007 Piane, Jr. ..... A63B 71/0036 482/142
2007/0155597 A1 * 7/2007 Hockemeyer ..... A63B 21/0783 482/99
2008/0051257 A1 * 2/2008 Hamblin ..... A63B 17/02 482/35
2008/0139367 A1 * 6/2008 Cooper ..... A63B 17/00 482/83
2009/0072111 A1 * 3/2009 Piane, Jr. ..... A63B 1/00 248/309.1
2009/0197740 A1 * 8/2009 Julskjaer ..... A63B 24/00 482/35
2010/0227743 A1 * 9/2010 Jutte ..... A63B 69/201 482/87
2015/0141205 A1 * 5/2015 Garland ..... A63G 31/00 482/35
2015/0335932 A1 * 11/2015 Chen ..... A63B 9/00 482/36
2016/0059105 A1 * 3/2016 Scade Garcia ..... E04H 1/12 52/69
2016/0184684 A1 * 6/2016 Ray ..... A63B 69/203 482/89
2017/0056705 A1 * 3/2017 Zha ..... A63B 23/03558

FOREIGN PATENT DOCUMENTS

EP 3115085 A1 * 1/2017 ..... A63B 21/4035
FR 2845613 A1 4/2004
GB 290629 A 8/1928
WO WO-2016039752 A1 * 3/2016 ..... A63B 9/00

OTHER PUBLICATIONS

International Search Report, dated Feb. 21, 2017, from corresponding PCT application No. PCT/IB2016/056838.
International Preliminary Report on Patentability, dated May 22, 2018, from corresponding PCT application No. PCT/IB2016/056838.

* cited by examiner (a)

(b)

(c)

(b)

(a)

(c)

(a)

(b)

(a)

(b)

(c)

(a)

(b)

(a)

(b)

(a)

(b)

(a)

(b)

(c)

PERSONALIZABLE MODULAR FITNESS AREA

FIELD OF THE ART

The present invention refers to a new type of reversibly installable modular fitness area for carrying out fitness exercises in public or private places, outside or in enclosed settings.

STATE OF THE ART

It is now widely recognized that carrying out physical sports activities is beneficial and not only for aesthetic reasons. Fitness indeed represents an actual condition of the organism which can be considered preventive against many diseases, and in any case such to make a person healthy—substantially, both for physical and mental wellbeing of the individual. Regular and assiduous conduction of physical sports activities leads to benefits such as: improvement of lymphatic circulation, strengthening of the locomotor apparatus and also of the immune system. Therefore, fitness also represents a preventive instrument for preventing the onset of diseases. Knowing that a state of physical and mental wellbeing can be reached due to the conduction of physical sports activities has made people increasingly motivated and inclined for physical training, whose benefits are even more evident if accompanied by a basically healthy lifestyle.

Therefore, for many years there has been the increasing need to set up places and structures equipped for carrying out many different sports activities.

Gyms/fitness areas undoubtedly represent the places where par excellence both individual and team sports are practiced; in addition, these structures for many represent the best choice, even only for the fact that they can be frequented at times that are not pre-established and usually incompatible with a person's common daily activities. Gyms/fitness areas are in fact open for use on days and at times that are decidedly more flexible than those set by competitive sports or specific courses. Nevertheless, even if the possibility to use equipped structures is appreciated—where personalized programs can be followed in a wide interval of hours that are not overlapped with other activities—there are in any case factors that represent an actual deterrent for frequenting fitness areas. In primis the economic aspect must be considered: the access to these places, the use of equipment as well as the possibility to follow the indications of a personal trainer understandably have costs that are not always accessible to the user. Another aspect regards their location: even if most inhabited centers, from small towns to big cities, generally have a plurality of gyms/fitness areas, reaching these structures is sometimes difficult especially when it is necessary to take public transportation that is not always reliable in terms of schedule, or use the car and search for a parking place in order to park it, which certainly represents a source of stress as well as a loss of time. A further factor that could be considered as inhibiting the user lies in the structure of the gyms/fitness areas themselves. These structures are in fact represented, in most cases, by closed places that—even if suitably climate-conditioned—they are still places where the air could be perceived as not very healthy due to the relative crowding of people carrying out the physical sports activity in a relatively small or in any case closed place. It is also to be considered that during the warmest periods of the year, which moreover often coincide with those when most carry out physical sports activities, the imposition of having to train in closed places in order to be able to use specific equipment as well as have professional assistance sometimes make the activity of exercise training annoying and unpleasant for many people—making outdoor training increasingly desirable. Presently, parks, gardens and the like are of course known where it is possible to find fixed equipment available to the user for fitness activities. Nevertheless, this equipment are actually decidedly different and simplistic if compared with that found in gyms/fitness areas. In addition, with respect to the latter, said public structures do not offer the user the right assistance for executing the exercises in the correct manner. It is in fact known that physical training brings benefits to the organism when the physical exercises are completed in a correct manner; otherwise, there could even be physical damage to the organism. Another aspect to consider is that often, even if the programs that each person could opt to follow by frequenting a common indoor gym/fitness area can be personalizable, the preliminary evaluations that associate the build of the single person with an appropriate and single body training/exercise path are still to be considered approximate. Sometimes, for example, in the screening of the individual's build, small body asymmetries tend not to be considered—while being macroscopically imperceptible, these are in any case present; consequently, it often occurs that the carrying out of physical exercises which do not account for such asymmetries inevitably involves a distribution of the loads which is different on the asymmetric portions. Therefore, the risk is that by subjecting the build to stresses and exercises that do not account for such characteristics (which moreover can be seen in most people), it actually becomes probable that the effects of such asymmetries are degenerated from mild into pathological conditions. At any rate, it is certain that the body training/exercise activity, by carrying out fitness exercises, is beneficial overall for the organism; nevertheless, the carrying out of such activities in the absence of an evaluation and selection suitable for the training/exercise program to be followed based on one's physical characteristics can sometimes involve complications. The risk of incorrectly carrying out the fitness activity is paradoxically an event that is now quite probable, if one considers that in spite of usable information from experts, most people do not wish to frequent places such as gyms/fitness areas and the like, substantially due to lack of time and sometimes for economic reasons, making an autonomous training in public places an increasingly reasonable experience. Nevertheless, it is recognized that presently there are very few urban centers in the world where it is possible to make use of outdoor or in any case public fitness areas that can offer the user the possibility to train at least in a similar way to that provided in indoor gyms/fitness areas (in which there is also professional assistance). In fact, those who train outdoors substantially perform activities such as running, on surfaces that are usually irregular or flat but inadequate, or simple activities of stretching which are nearly never followed by professionals like personal trainers. For such purpose, the object of the present industrial invention patent application, described in detail hereinbelow, is to propose a modular fitness area comprising a plurality of specific components for carrying out particular exercises whose mode of actuation is illustrated to the user by means of a suitable mobile application or directly on displays comprised in the fitness area itself. More in detail, object of the present invention is to propose a modular system to the user that is structured like a gym/fitness area comprising a plurality of variously assemblable modules which allow attaining a sophisticated fitness area comparable to the more modern common indoor gyms/fitness areas and which offer users technologically advanced instruments and equipment pieces as well as professionals that follow the users in carrying out the fitness activity. The present invention intends, more in detail, to propose a fitness area which is a personalizable structure for carrying out fitness activities, ensuring all the benefits that can be found in the services offered in common indoor gyms/fitness areas.

DESCRIPTION OF THE INVENTION

The present industrial invention patent application describes a new reversibly installable and variously modular fitness area that is such to make the fitness activity personalizable based on the build and on the needs of the single users. The present modular fitness area is also a reversibly installable, decidedly functional and effective structure comprising a plurality of technologically advanced equipment pieces, thus being comparable to the most advanced common indoor gyms/fitness areas.

Advantageously this characteristic allows facilitating the installation of the present fitness area in various sites, preferably in open places, with the aim of allowing users to carry out fitness activities in places different from conventional indoor gyms/fitness areas.

Advantageously the possibility of being able to train/exercise outdoors and in public places offers a wide variety of hours during which the fitness activity can be carried out, thus representing an incentive for performing activities that are healthy for the organism.

Advantageously, since the present fitness area is to be preferably but not exclusively installed in public places, this allows making use of equipment comprised therein at considerably reduced if not zero costs, with respect to the conventional indoor gyms/fitness areas.

Advantageously the present modular fitness area, being variously modular based on the single needs of the users, allows executing personalized body training programs.

BRIEF DESCRIPTION OF THE DRAWINGS

FIGS. 1(*b*) and 1(*c*) respectively show a side view and a plan view of said personalizable modular fitness area.

FIGS. 2(*a*), 2(*b*) and 2(*c*) respectively show a front, side and plan view of said first stage 1.

FIGS. 2(*a*), 2(*b*) and 2(*c*) respectively show a front, side and plan view of said third stage 3.

FIGS. 4(*a*), 4(*b*) and 4(*c*) respectively show a front, side and plan view of said third stage 3.

FIGS. 5(*a*) and 5(*b*) respectively show a front and plan view of said fourth stage 4.

FIGS. 6(*a*), 6(*b*) and 6(*c*) respectively show a front, side and plan view of said fifth stage 5.

FIGS. 7(*a*), 7(*b*) and 7(*c*) respectively show a front, side and plan view of said sixth stage (6).

FIGS. 7(*a*) and 7(*b*) respectively show a front and side view of said seventh stage 7.

FIGS. 9(*a*), 9(*b*) and 9(*c*) respectively show a front, side and plan view of said eighth stage (8).

FIGS. 10(*a*) and 10(*b*) respective show a front and side view of said ninth stage 9.

FIGS. 11(*a*) and 11(*b*) respectively show a front and side view of said tenth stage 10.

FIGS. 12(*a*) and 12(*b*) respectively show a front and side view of said eleventh stage 11.

FIGS. 13(*a*), 13(*b*) and 13(*c*) respectively show a front, side and plan view of said twelfth stage 12.

DESCRIPTION OF THE PREFERRED EMBODIMENTS

Figure 1A:
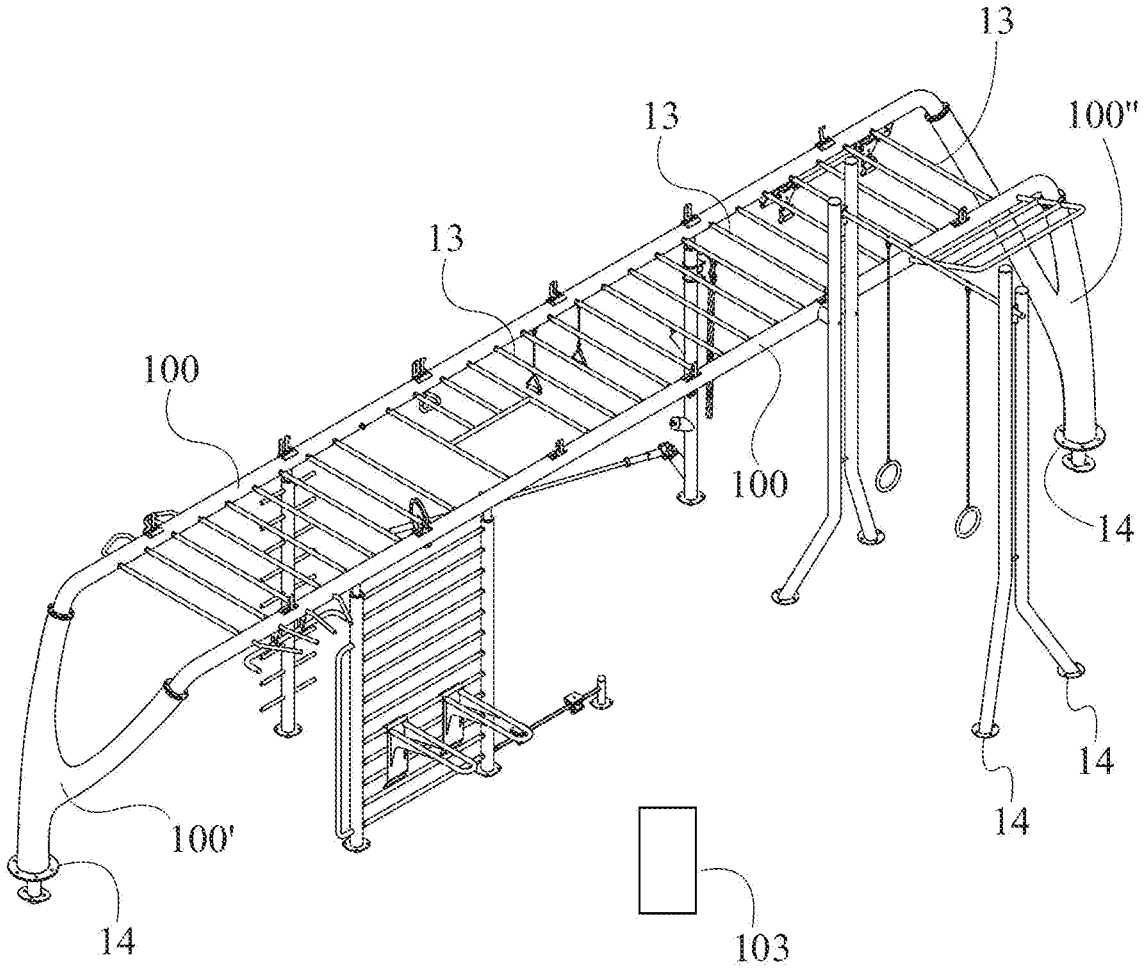
FIG. 1 show various views of the personalizable modular fitness area, object of the present industrial invention patent application and of the at least twelve stages comprised therein. More in detail the FIG. 1(*a*) shows a perspective view of said modular fitness area. The various stages and the modules 100 can be observed in such figure. In particular the figure in question intends to show the characteristic sling-like shape of the opposite support modules 100' and 100" arranged orthogonal to the ground. Also observable are the flanges 14 adapted to stably and reversibly connect the modules 100 to the ground. The figure also shows the presence of the plurality of transverse bars 13 adapted to allow users of the modular fitness area to carry out strength and routine exercises.
Figure 1B:
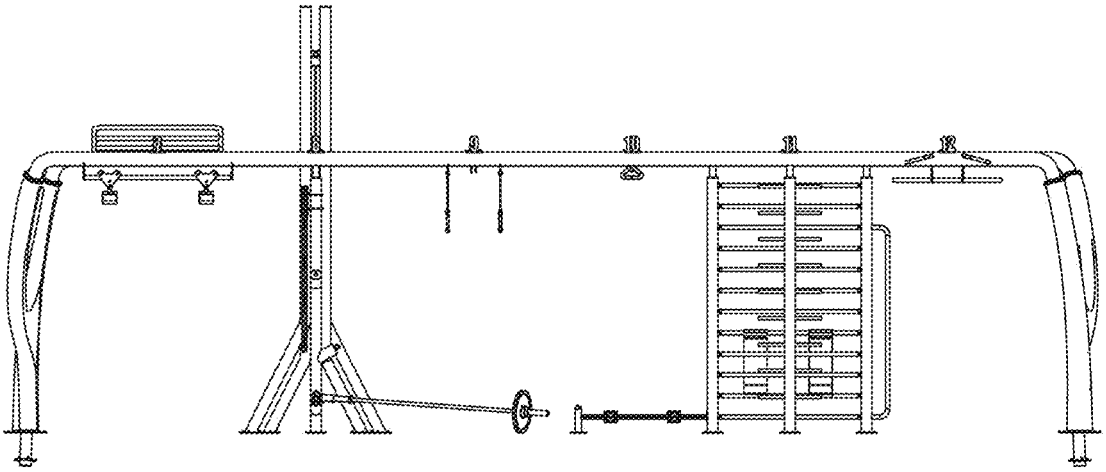
Figure 1C:
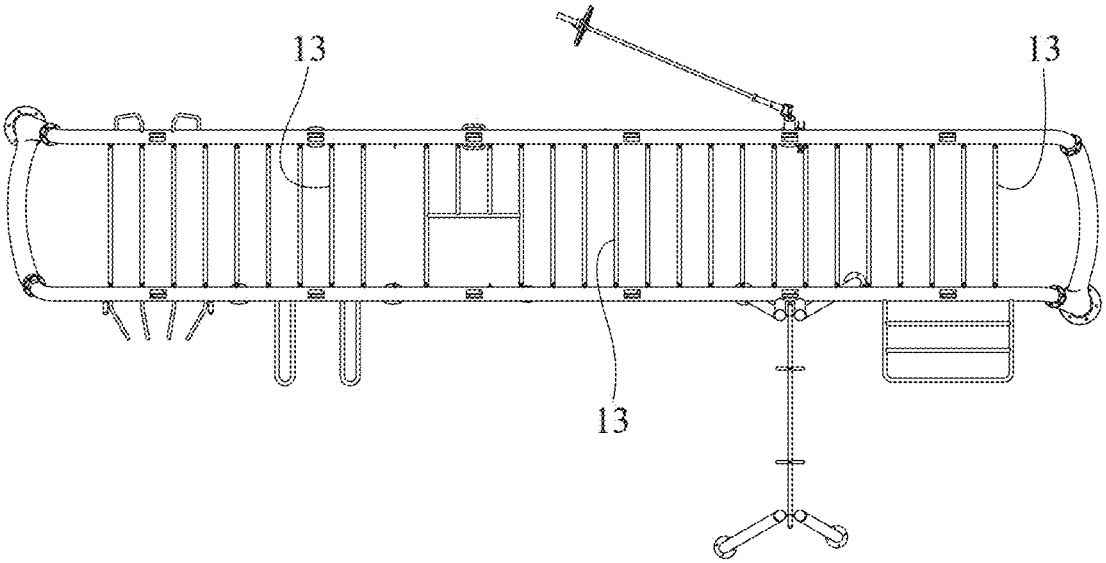
Figure 2:
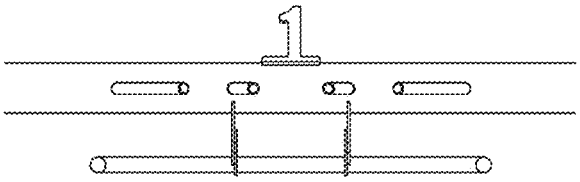
FIG. 2 show various views of the first stage of the modular fitness area. Said stage 1 comprises grips for traction and at least one traction bar.
Figure 2:
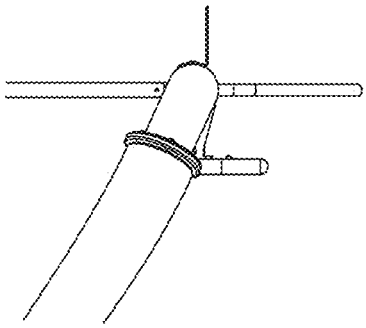
Figure 2:
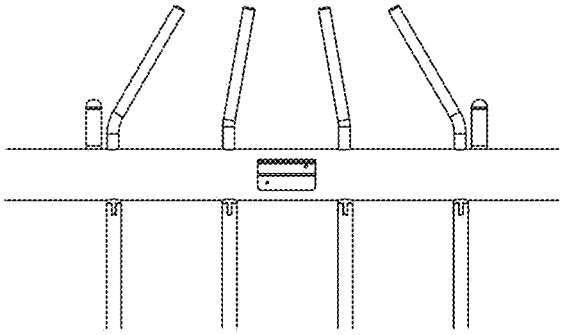
Figure 3:
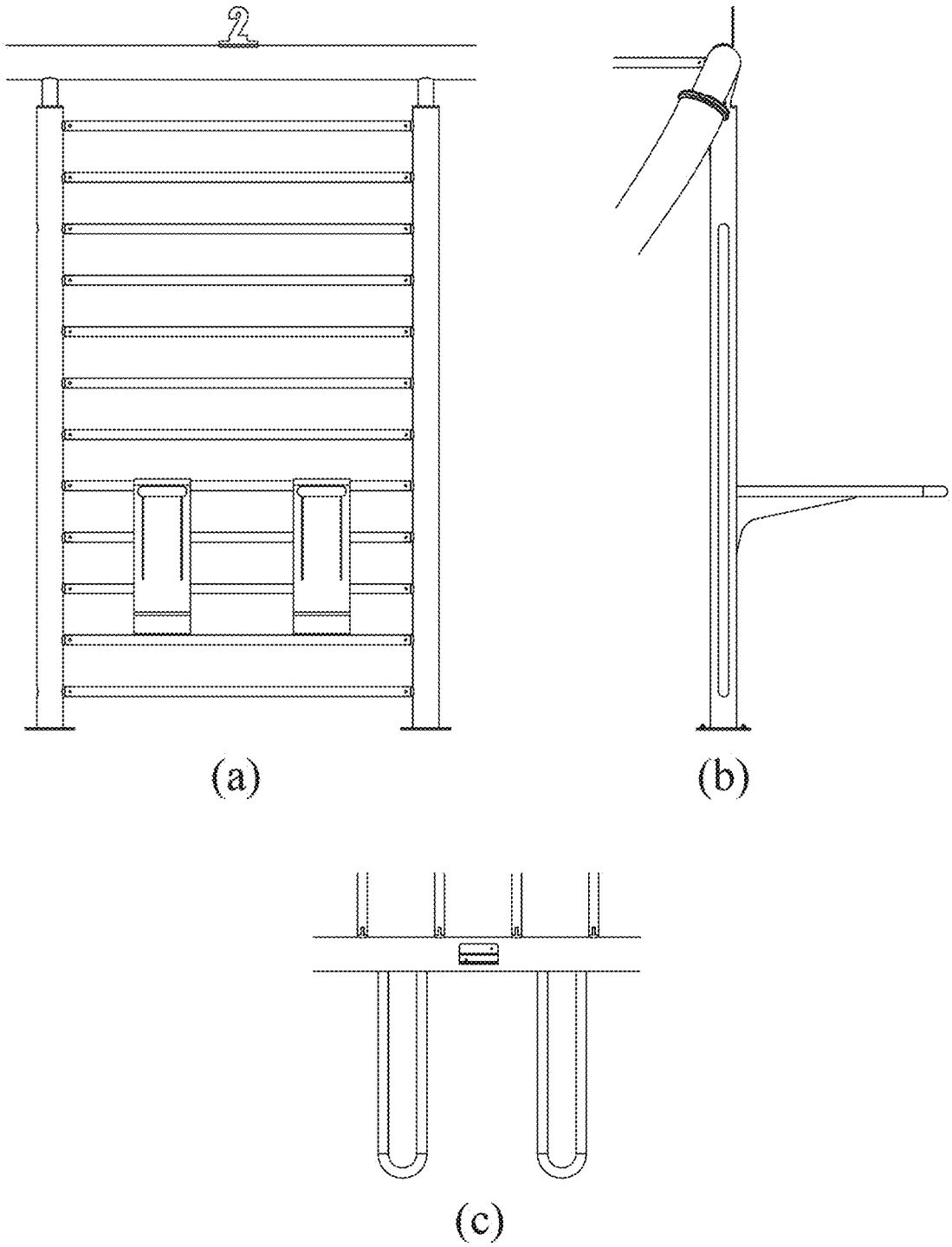
FIG. 3 show various views of the second stage 2 of the present modular fitness area. More in detail said stage 2 comprises at least one wall bars unit and at least parallel bars.
Figure 4:
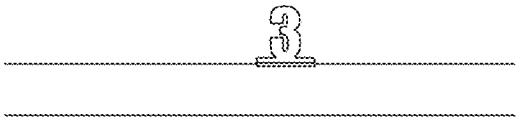
FIG. 4 show various views of the third stage 3 of the modular fitness area. More in detail, the figure in question shows that said third stage 3 comprises slidable push up, provided with handles for different openings and closures.
Figure 4:
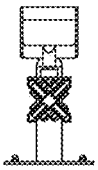
Figure 4:
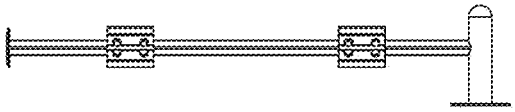
Figure 4:
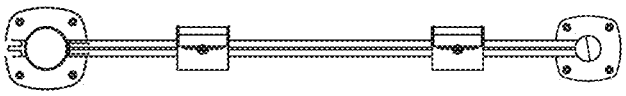
Figure 5:
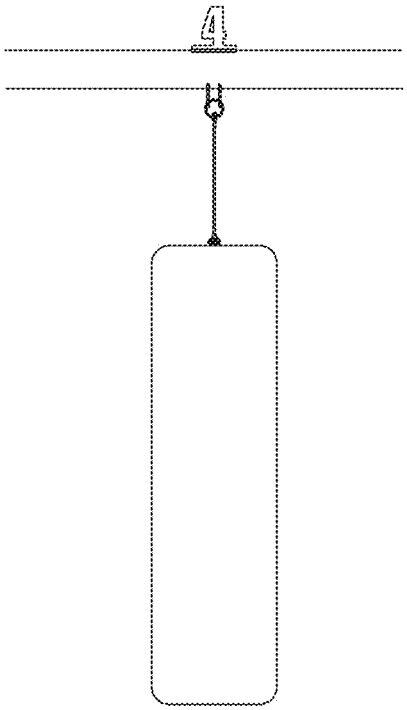
FIG. 5 show various views of the fourth stage 4 of the modular fitness area. More in detail, the figure in question shows that said fourth stage 4 comprises at least one boxing bag.
Figure 5:
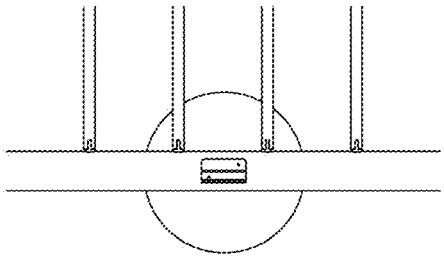
Figure 6:
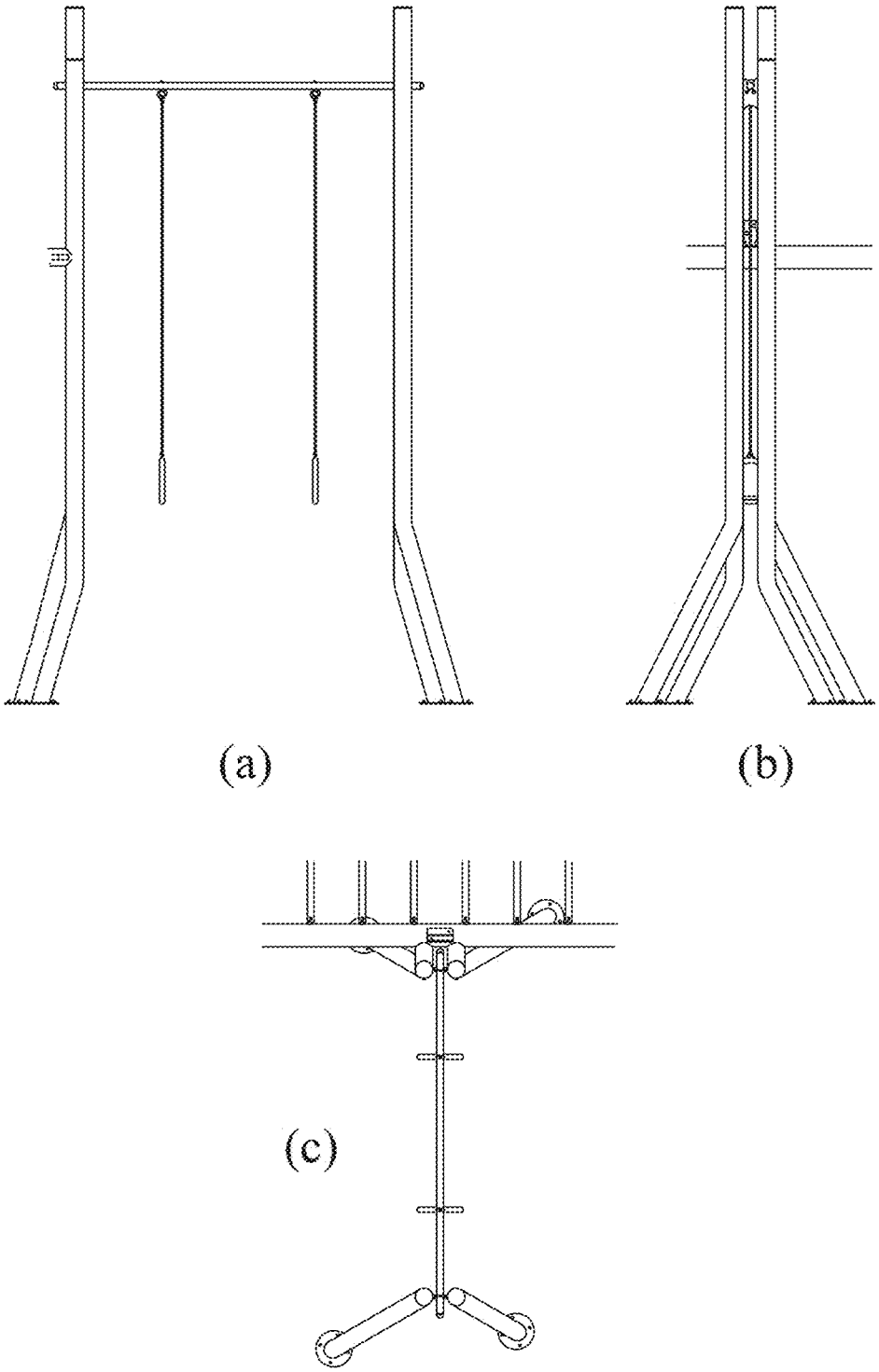
FIG. 6 show various views of the fifth stage 5 of the modular fitness area. More in detail the figure in question shows that said fifth stage 5 comprises rings for carrying out fitness exercises.
Figure 7:
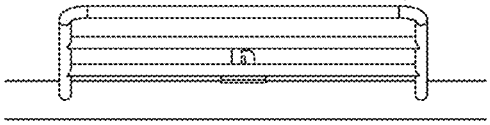
FIG. 7 show various views of the sixth stage 6 of the modular fitness area. More in detail, the figure in question shows that said sixth stage comprises at least one traction bar for carrying out fitness exercises.
Figure 7:
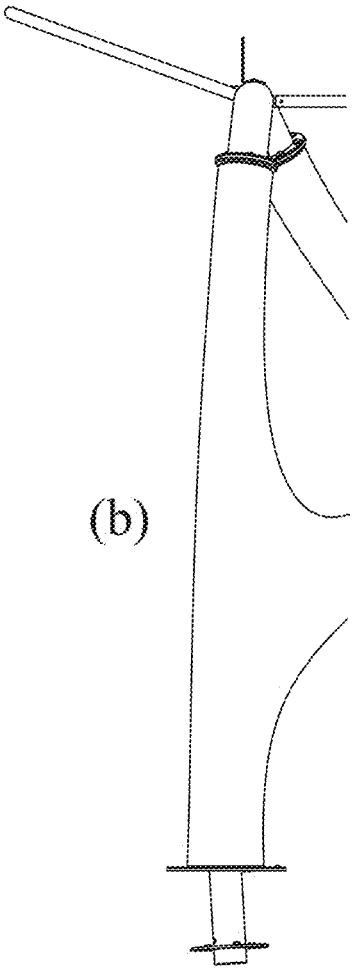
Figure 7:
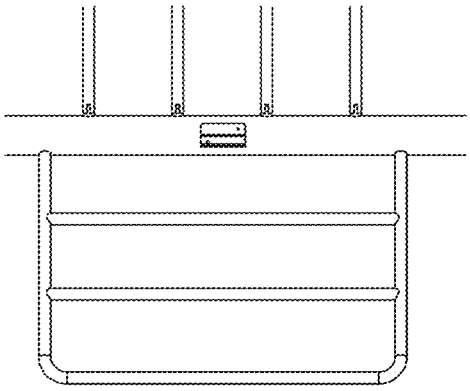
Figure 8:
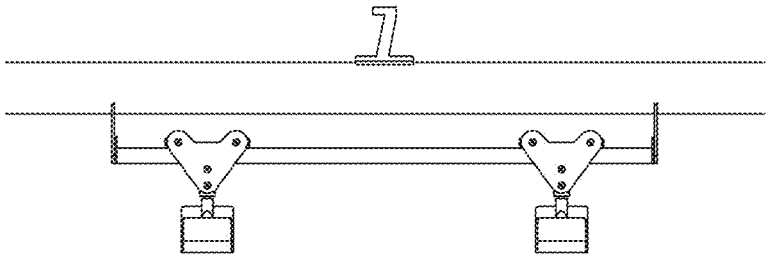
FIG. 8 show various views of the seventh stage 7 of the modular fitness area. More in detail the figure shows that said seventh stage 7 comprises handles slidable from the top for carrying out fitness exercises.
Figure 8:
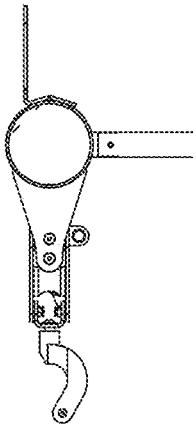
Figure 9:
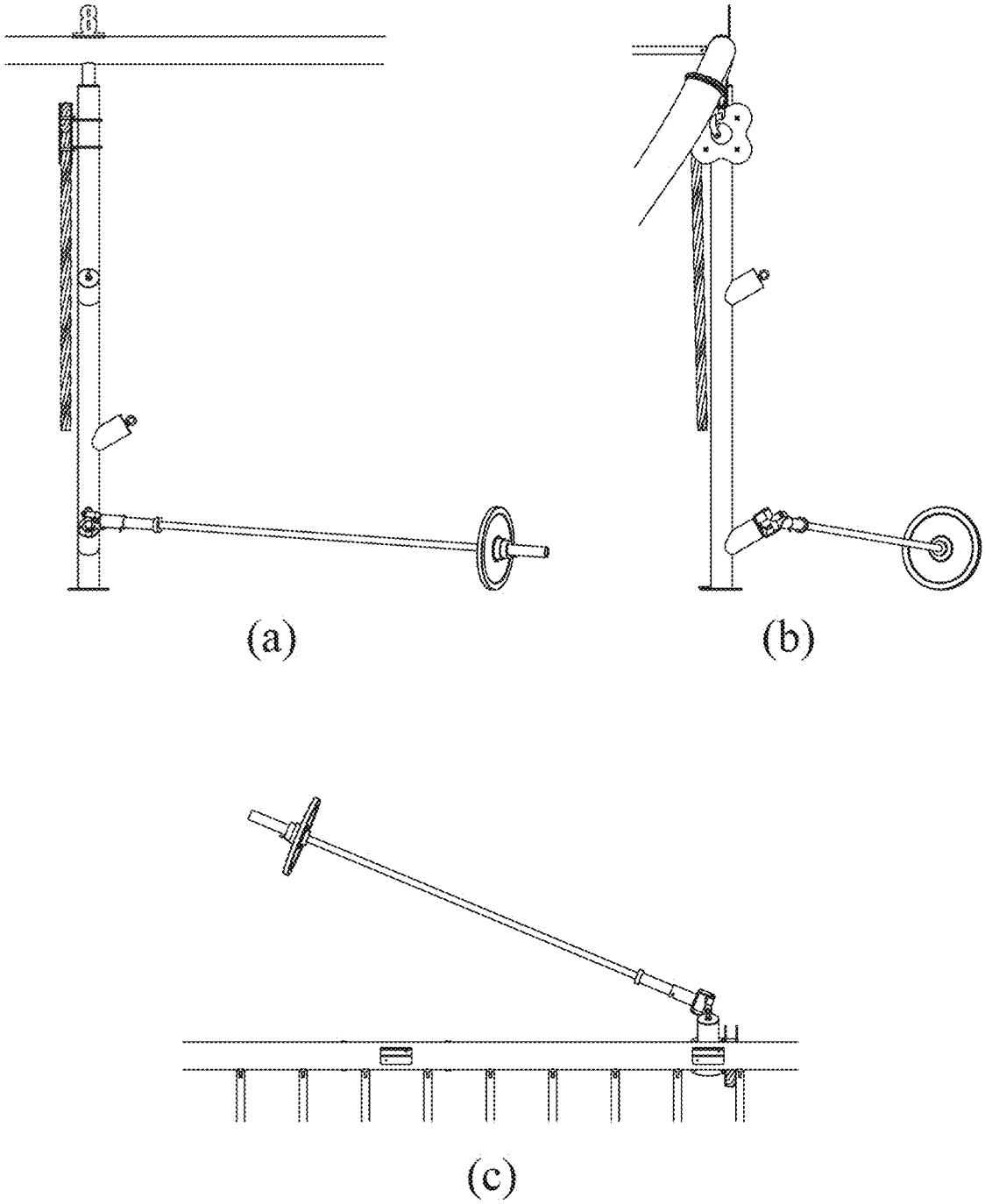
FIG. 9 show various views of the eighth stage 8 of the modular fitness area. More in detail, the figure in question shows that said eighth stage 8 comprises at least one cable, at least one balance and at least elastic cords for carrying out fitness exercises.
Figure 10:
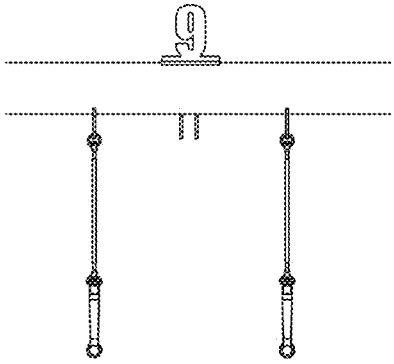
FIG. 10 show various views of the ninth stage 9 of the modular fitness area. More in detail the figure shows that said ninth stage 9 comprises handles with suspended cables for carrying out fitness exercises.
Figure 10:
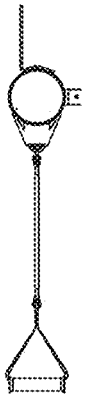
Figure 11:
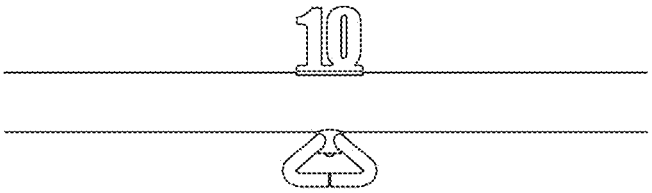
FIG. 11 show various views of the tenth stage 10 of the modular fitness area. More in detail the figure in question shows that said tenth stage 10 comprises at least one traction butterfly for carrying out fitness exercises.
Figure 11:
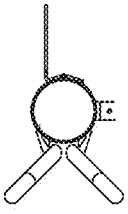
Figure 12:
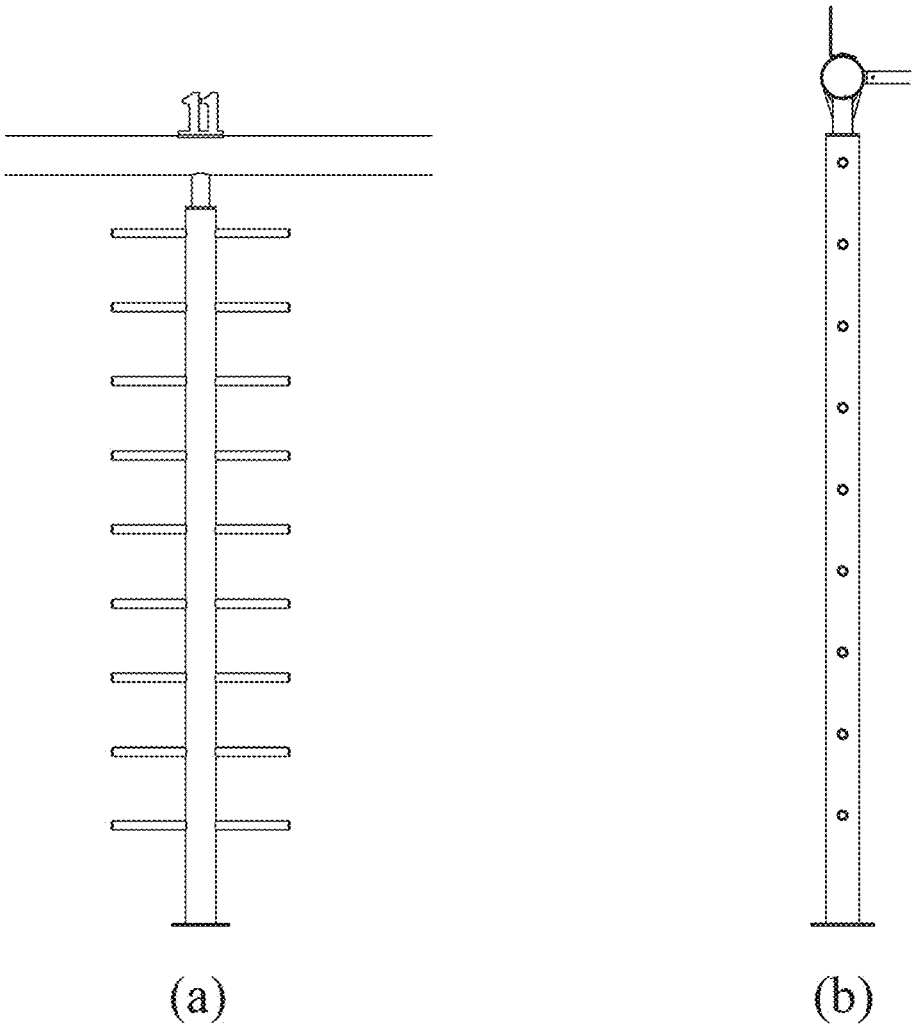
FIG. 12 show various views of the eleventh stage 11 of the modular fitness area. More in detail the figure shows that said eleventh stage 11 comprises at least one ladder for carrying out fitness exercises.
Figure 13:
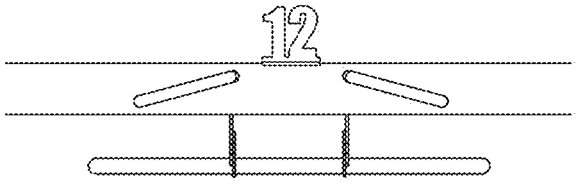
FIG. 13 show various views of the twelfth stage 12 of the modular fitness area. More in detail the figure in question shows that said twelfth stage 12 comprises at least two grips for carrying out traction exercises.
Figure 13:
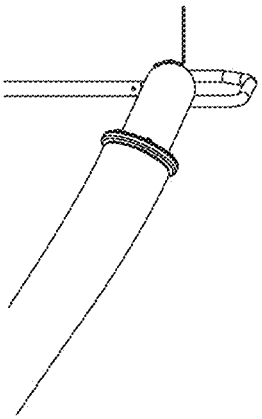
Figure 13:
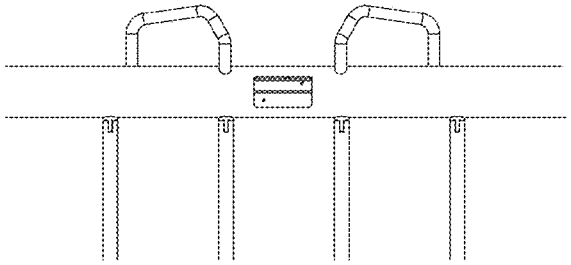

In the preferred embodiment thereof, the personalizable modular fitness area (indicated hereinbelow as modular fitness area), object of the present industrial invention patent application, is a structure comprising a plurality of modules 100, variously assemblable, which when joined together give rise to structures which in the course of the present description will be indicated as stages, each of which comprising one or more equipment pieces for carrying out fitness exercises. More in detail the modular fitness area comprises:

at least one first stage 1 comprising grips for traction bars, and at least one traction bar for carrying out exercises for training/exercising the back, trunk, biceps and abdominals. Still more in detail the first stage 1 preferably comprises four grips for traction and one traction bar. Said first stage 1 allows executing a series of movements adapted to develop strength, stamina and balance. More specifically: from simple traction exercises where the back and arm muscles are stressed, to more complex exercises where all the muscles of the body are summoned into action in a more complete manner. The abdominal muscle can be stressed in an isometric manner without contraction and hence with stability function, or in a dynamic manner with specific exercises. The different structures of the four grips and of the bar itself allow using the muscles themselves in a complete manner;

at least one second stage 2 comprising at least one wall bars unit and at least one accessory for triceps adapted to allow carrying out stretching, flexibility and abdominal exercises and the use of the wall bars unit for coupling elastic cables and for carrying out traction with the arms and abdominals. More in detail said second stage 2 comprises a wall bars unit and small parallel bars. The wall bars unit allows proposing the greatest variety of exercises for stretching and for posture, but simultaneously is also used for developing muscle tone: elastic cords and cables can be added to the wall bars unit with which exercises are possible for all muscle districts. In addition, the parallel bars can be dismantled, thus allowing the execution of many different exercises while suspended for the muscles of the chest, of the shoulders, of the arms and of the abdomen;

at least one third stage 3 comprising slidable push-ups, provided with handles for different openings and closures, for carrying out exercises for the pectorals and for the shoulders and also for leg extension exercises. More specifically said third stage 3 preferably comprises handles slidable on the ground which offer the possibility to develop the musculature of the chest and triceps both in standard manner and through the sliding of the handles themselves, increasing the difficulty and stressing the abdominals and the stabilizer muscles in the most active manner. Said third stage 3 is also usable for leg extension exercises;

at least one fourth stage 4 comprising at least one boxing bag for carrying out all the boxing and martial arts exercises;

at least one fifth stage 5 comprising rings for carrying out all the stamina exercises for back, shoulders, biceps and triceps and abdominals while suspended. More in detail the rings allow developing strength and stamina by exploiting the weight of one's body. In addition, exercises are proposed which affect the stabilizers of the shoulder, of the wrist, of the back and of the abdominals;

at least one sixth stage 6 comprising at least one tilted traction bar for all the exercises of the back, trunk, biceps and abdominals with variable height and for offering the possibility to couple accessories for antigravity yoga and for coupling cables. More in detail the tilted traction bars give the possibility to execute incremental exercises incremental that develop strength, stamina and balance. The muscles of the back, of the arms and of the abdominals are those which are mainly used, but through the combination of multiple movements, also legs, chest and shoulders can be stressed. The possibility to couple TRX cables, and the possibility to carry out antigravity yoga makes the station a multifunctional zone of great utility;

at least one seventh stage 7 comprising slidable traction bars for allowing the carrying out of exercises of the back, trunk, biceps and abdomen; and slidable handles for different openings and closures. More in detail, said seventh stage 7 comprises handles slidable from the top which offer the possibility to develop the musculature of the back, of the arms and of the abdomen both in standard manner and through the sliding of the handles, increasing the difficulty and stressing the abdominals and the stabilizer muscles in a more active manner. Said seventh stage 7 offers the possibility to propose work protocols with different opening angles in order to increase the sensitivity and the perception of one's body;

at least one eighth stage 8 comprising at least one cable, at least one barbell and elastic cords, for carrying out intensity and strength exercises with the cord, and for training/exercising chest, shoulders, gluteus, triceps. More in detail, said stage 8 represents the multifunctional stage par excellence of the present modular fitness area. Indeed, cables, barbell and elastic cords allow using the muscles of the entire body at different work angles, in order to improve performance regarding intensity and stamina, strength and proprioceptors. The hooks for the elastic cords positioned at the different heights allow different muscular work inclinations. All muscles of the body can be used;

at least one ninth stage 9 comprising handles with suspended cables for carrying out all the exercises while suspended for training/exercising the back, the abdominals and the biceps. More in detail, in this station, the perception of the body while suspended with two handles allows improving the musculature of the back, of the arms and of the abdominals, in addition to improving the strength and stamina;

at least one tenth stage 10 comprising at least one traction butterfly for carrying out exercises for the back and for the biceps with narrow grip. More in detail said tenth stage 10 allows carrying out all the traction exercises with narrow grip, in order to stress the muscle at different grips, in particular muscles of the back, of the arms and of the abdominals;

at least one eleventh stage 11 comprising at least one ladder for allowing the carrying out of all the leg exercises, for executing jumps and for training/exercising the pectorals at different inclinations and for allowing the carrying out of exercises by means of elastic cables to be arranged, due to said ladder, at different height from the ground. More in detail, the ladder allows a series of propaedeutical exercises, in order to assist neophytes in learning to perform the standard exercises for training/exercising the lower limbs, upper limbs, pectoral muscles, back muscles and abdominals and for carrying out exercises at different inclinations of the latter, with the possibility of using elastic cords and/or cables at different heights, making said eleventh stage 11 a station of reference for users who wish to improve their exercise technique; and at least one twelfth stage 12 comprising at least two traction grips for carrying out exercises for training/exercising the back, trunk, biceps and abdominals.

More in detail said twelfth stage 12 allows carrying out traction exercises with different grips in order to allow stressing the muscles at different work angles. The muscles of the back, arms and abdomen are mainly stressed but through combined movements, also the muscles of the lower limbs can be developed.

The present modular fitness area is a structure such to have, between the aforesaid at least twelve stages, a plurality of elements of connection between said stages. Said connection elements are shaped as transverse bars 13 adapted to allow the user to carry out strength and routine exercises. More in detail, said transverse bars 13 allow executing multiple types of exercises such as: traction, sliding between the bars, hand-to-hand passage, explosive exercises that also involve the lower limbs, abdominals while suspended and use of the abdomen for maintaining the body in equilibrium. Said modular fitness area also comprises accessories such as known systems for carrying out step exercises in order to perform exercises of agility and leg strengthening, which can also be used as accessory for facilitating the climbing access to some of the equipment pieces comprised in the aforesaid stages that are situated spaced from the ground.

As repeated several times in the course of the present description, the present modular fitness area is a structure which allows performing fitness exercises in a personalizable manner as a function of the needs of the single user. The latter can also form an overall structure, hence a modular fitness area, which has an extension comprised between 3 and 15 meters, preferably between 4.5 m and 12 m. The present modular fitness area is also characterized for offering the user the possibility to view, on a device such as a smartphone, a tablet and/or the like, videos which illustrate the correct way to carry out the exercise execute by a professional trainer. All this occurs by downloading a suitable mobile application. The attainment of such service makes use of Bluetooth technology. Such technology is arranged for every single stage that is marked with a specific number. The illustration of how to carry out the exercise is associated with each of said stages.

In addition and/or as an alternative, the present modular fitness area comprises at least one, preferably a plurality of totem-shaped columns 103, each comprising at least one display (actuatable with touch screen mode) showing the user the correct way to perform the exercise executed by a professional trainer.

It should be indicated that the correct ways to carry out the fitness exercises that can be performed with the fitness area 1 are also observable due to a suitable mobile application downloadable on electronic devices, typically portable, which provide the user with a plurality of demonstration videos. By way of a non-limiting example, 250 video exercises with Bluetooth technology.

A particular embodiment of the modular fitness area according to the present invention provides that a plurality of stages are comprised in said fitness area that are shaped like technical floors, also adapted to carrying out fitness exercises on the ground and which are optionally also provided with specific equipment pieces for carrying out such exercises. Said technical floors are identifiable with specific nomenclature and are also associated with corresponding demonstration videos. Some embodiments of the present modular fitness area also provide that it comprises cameras, systems for Wi-Fi connection and columns for recharging electronic devices such as smartphones, tablets and the like.

In all embodiments thereof, the present modular fitness area is characterized in that it is a structure reversibly installable in the sites of interest, typically but not exclusively public or private outdoor sites. The various modules 100 comprised in said modular fitness area are reversibly assemblable on the ground and to each other, using as connection elements common flanges 14 or other similarly effective connection elements. Overall the modular fitness area appears as a compact structure in which the various modules 100 are joined for defining a framework without interruption and lacking edges. Of particular importance are two opposite support modules 100' and 100" arranged orthogonal to the ground which are characterized in that they are shaped like slings. This particular profile, in addition to giving rise to an aesthetically agreeable overall structure, covers an important functional role since it contributes to making the overall structure, and in particular the framework of the fitness area, as well as the fitness area in its entirety, particularly stable when the components of the present stages are subjected to mechanical stresses caused by the users and/or by possible actions of another type. Such profile, in combination with the materials comprised in the modules 100, actually attribute an elastic behavior to the framework of the modular fitness area. In all embodiments thereof, the modular fitness area can be made of metal material, and/or polymer material and/or composite material. Preferably said modular fitness area can be made of metal material comprising harmonic steel and/or in materials comprising amorphous polymers and/or in composite materials comprising elastic fibers.

The invention claimed is:

1. A personalizable modular fitness area formed of a plurality of modules (100), variously assemblable due to common stable and reversible connection systems joinable together with one another, each of said plurality of modules formed of one or more equipment pieces for carrying out fitness exercises, said modular fitness area comprising:

at least one first stage (1) comprising grips for traction and at least one traction bar for carrying out exercises for training/exercising biceps, back, trunk, and abdominals;

at least one second stage (2) comprising at least one wall bars unit and parallel bars for carrying out exercises for training/exercising triceps, for carrying out stretching, flexibility and abdominal exercises, and for allowing use of the wall bars unit for coupling elastic cables and for carrying out traction with arms and abdominals;

at least one third stage (3) comprising first handles slidable on the ground, with different openings and closures, for carrying out exercises for pectorals, for shoulders, and for leg extension exercises;

at least one fourth module (4) comprising at least one boxing bag for carrying out boxing and martial arts exercises;

at least one fifth stage (5) comprising rings for carrying out stamina exercises for back, shoulders, biceps, triceps, and abdominals while suspended;

at least one sixth stage (6) comprising at least one tilted traction bar for exercises of biceps, back, trunk, and abdominals with variable height and configured to permit coupling with accessories for antigravity yoga and for coupling cables;

at least one seventh stage (7) comprising second handles slidable from a top in order to allow carrying out exercises of biceps, back, trunk, and abdomen with said second slidable handles configured for different openings and closures;

at least one eighth stage (8) comprising at least one cable, at least one barbell, and elastic cords, for carrying out intensity and strength exercises, and for training/exercising shoulders, chest, gluteus, and triceps;

at least one ninth stage (9) comprising third handles with suspended cables for carrying out all the exercises for training/exercising abdominals, back, and biceps while suspended;

at least one tenth stage (10) comprising at least one traction butterfly for carrying out exercises for back and for biceps with narrow grip;

at least one eleventh stage (11) comprising at least one ladder for allowing carrying out of leg exercises, for executing jumps, for training/exercising pectorals at different inclinations, and for allowing carrying out of exercises by means of elastic cables arrangeable, via said ladder, at different height from the ground;

at least one twelfth stage (12) comprising at least two traction grips for carrying out exercises for training/exercising biceps, back, trunk, and abdominals; and a plurality of transverse bars (13) for carrying out strength and routine exercises, and comprising accessories for carrying out step exercises, wherein said modular fitness area is configured such that connection of said modules (100) defines a framework having elastic behavior in response to mechanical stresses, wherein among said modules (100), two of said modules (100) are shaped like slings, the two modules shaped like slings being opposite support modules (100',100") arranged orthogonal to the ground, wherein among said modules (100), at least said opposite support modules (100',100") comprise elastic material, and wherein said modular fitness area comprises totem-shaped columns for each stage present therein, adapted to comprise at least one display which shows users, upon actuation of a with touch screen, a video that illustrates a correct way to carry out one or more fitness exercises associated with the corresponding stage.

2. The personalizable modular fitness area according to claim 1, wherein an overall extension is between 3 m and 15 m.

3. The personalizable modular fitness area according to claim 2, wherein the extension is between 4.5 m and 12 m.

4. The personalizable modular fitness area according to claim 2, further comprising:

cameras for video-surveillance.

5. The personalizable modular fitness area according to claim 3, further comprising:

cameras for video-surveillance.

6. The personalizable modular fitness area according to claim 2, further comprising:

columns for recharging electronic devices.

7. The personalizable modular fitness area according to claim 3, further comprising:

columns for recharging electronic devices.

8. The personalizable modular fitness area according to claim 1, further comprising:

cameras for video-surveillance.

9. The personalizable modular fitness area according to claim 1, further comprising:

columns for recharging electronic devices.

10. The personalizable modular fitness area according to claim 1, wherein the video that illustrates the correct way to carry out the one or more fitness exercises are observable via a mobile application.

11. The personalizable modular fitness area according to claim 1, wherein among the modules (100), at least the opposite support modules (100',100") are made of any of metal material comprising harmonic steel, materials comprising amorphous polymers, and composite materials comprising elastic fibers.

12. A method for performing fitness exercises in public and/or private places, outside and/or in enclosed settings, comprising providing the modular fitness area of claim 1, and utilizing the modular fitness area to perform said fitness exercises.

* * * * *